US012746482B2

(12) United States Patent
Feng et al.

(10) Patent No.: US 12,746,482 B2
(45) Date of Patent: Sep. 29, 2026

(54) TRACK MODULE AND TOY CAR TRACK

(71) Applicant: Shengwen Wu, Xiaoyi City (CN)

(72) Inventors: Liang Feng, Xiaoyi City (CN); Shengwen Wu, Xiaoyi City (CN)

(73) Assignee: Shengwen Wu, Xiaoyi City (CN)

( * ) Notice: Subject to any disclaimer, the term of this patent is extended or adjusted under 35 U.S.C. 154(b) by 0 days.

(21) Appl. No.: 19/451,113

(22) Filed: Jan. 16, 2026

(65) Prior Publication Data

US 2026/0199799 A1 Jul. 16, 2026

(30) Foreign Application Priority Data

Jan. 16, 2025 (CN) ..... 202520111164.5

(51) Int. Cl.
*A63H 18/02* (2006.01)

(52) U.S. Cl.
CPC ..... *A63H 18/02* (2013.01)

(58) Field of Classification Search
CPC ..... A63H 18/00; A63H 18/02; A63H 18/021
See application file for complete search history.

(56) References Cited

U.S. PATENT DOCUMENTS 4,496,100 A 1/1985 Schwager et al.
2018/0128477 A1* 5/2018 Balanchi ..... F21V 33/008

* cited by examiner

*Primary Examiner* — Robert J McCarry, Jr.

(57) ABSTRACT

A track module and a toy car track. The track module includes multiple track units. Each track unit includes a connecting portion and two track portions. The connecting portion is arranged with a protruding portion and a groove. A rotating part and a mating part are arranged between the protruding portion of a rear track unit and the groove of a front track unit. The connecting portion is arranged with first abutting surfaces and second abutting surfaces. When the track module is in a straight shape, the first abutting surface of a rear track unit and the second abutting surface of a front track unit are spaced apart. Two adjacent track units can be swung laterally until the first abutting surface on a bent side of the rear track unit abuts against the second abutting surface on the bent side of the front track unit, to limit a swing amplitude.

19 Claims, 8 Drawing Sheets

TRACK MODULE AND TOY CAR TRACK

CROSS-REFERENCE TO RELATED APPLICATIONS

The present application claims foreign priority of Chinese Patent Application No. 202520111164.5, filed on Jan. 16, 2025, in the China National Intellectual Property Administration, the entire contents of which are hereby incorporated by reference in its entirety.

TECHNICAL FIELD

The present disclosure relates to the technical field of toys, and in particular, to a track module and a toy car track.

BACKGROUND

A toy car track is a structure that provides a driving path for toy cars. To increase fun and flexibility of the track, the track typically includes multiple track modules, which can often be freely assembled and connected to form tracks of different shapes, such as straight tracks, curved tracks, circular tracks, or ramps.

In the related art, a track module usually includes multiple track units connected in sequence. The connection between two adjacent track units may be in one of three states: straight, left turn, or right turn. A subsequent track unit is typically engaged with and connected to (e.g. snap-connected to) the preceding track unit, and the swing angle is limited by walls of a slot. This may result in restricted swing angles, failing to meet user demands for large turns. Additionally, the precision requirements for components are high, which is not conducive to improving production efficiency.

The above content is intended to assist in understanding the technical solution of the present disclosure and does not constitute an admission that the above content is related art.

SUMMARY OF THE DISCLOSURE

In view of the above problems, the present disclosure proposes a track module, aiming to solve the technical problem of traditional track modules having a small turning angle.

To achieve the above objective, the track module proposed by the present disclosure includes a plurality of track units connected sequentially; wherein each track unit includes a connecting portion and two track portions disposed on opposite sides of the connecting portion in a first direction;

wherein the connecting portion is arranged with a protruding portion and defines a groove, and the protruding portion and the groove are disposed on opposite sides in a front-rear direction;

for each adjacent two track units among the plurality of track units, the adjacent two track units are a front track unit and a rear track unit in the front-rear direction; a rotating part and a mating part are arranged between the protruding portion of the rear track unit and the groove of the front track unit, enabling the adjacent two track units to be swingably connected in a lateral direction; the first direction and the front-rear direction intersect each other on a horizontal lateral plane; the protruding portion and the groove are disposed in a middle part of the connecting portion; a front end of the connecting portion is arranged with two first abutting surfaces located on opposite sides of the protruding portion in the first direction; a rear end of the connecting portion is arranged with two second abutting surfaces corresponding to the first abutting surfaces;

in a case where the track module is in a straight shape, the two first abutting surfaces of the rear track unit and the two second abutting surfaces of the front track unit are arranged spaced apart;

the adjacent two track units are capable of being swung laterally relative to each other to a bent state on one side; in the bent state, one of the two first abutting surfaces located on a bent side of the rear track unit abuts against the one of the two second abutting surfaces located on the bent side of the front track unit, for limiting a swing amplitude of the adjacent two track units.

In some embodiments, at least one of each first abutting surface and each second abutting surface is an abutting inclined surface;

in a case where the track module is in the straight shape, a first gap exists between each first abutting surface of the rear track unit and a corresponding second abutting surface of the front track unit; the abutting inclined surface is inclined from the connecting portion towards a side of the track portion in the first direction, deviating from the first gap, causing the first gap to gradually increase from the middle part towards an outer side in the first direction.

In some embodiments, a front end of each track portion is arranged with a first track inclined surface connected to a corresponding first abutting surface; a rear end of each track portion is arranged with a second track inclined surface connected to a corresponding second abutting surface;

the first track inclined surface extends obliquely in a same direction as the first abutting surface;

the second track inclined surface extends obliquely in a same direction as the second abutting surface.

In some embodiments, the rotating part is an arc-shaped protrusion arranged on the protruding portion; the arc-shaped protrusion extends from one of the two first abutting surfaces to the other of the two first abutting surfaces around a peripheral direction of the arc-shaped protrusion;

the mating part is an insertion hole defined on a bottom wall of the groove; the insertion hole extends from one of the two second abutting surfaces to the other of the two second abutting surfaces around the peripheral direction of the arc-shaped protrusion;

the arc-shaped protrusion of the rear track unit is capable of being rotatably inserted into the insertion hole of the front track unit, enabling each first abutting surface and a corresponding second abutting surface located on a same side to abut against each other.

In some embodiments, the arc-shaped protrusion is arranged with at least one engaging block; the at least one engaging block of the rear track unit is capable of being detachably engaged in the insertion hole of the front track unit, and the at least one engaging block of the rear track unit is slidable within the insertion hole of the front track unit along the peripheral direction of the arc-shaped protrusion of the rear track unit.

In some embodiments, the at least one engaging block is two engaging blocks; the two engaging blocks are respectively disposed on opposite sides of the arc-shaped protrusion in a longitudinal direction; the two engaging blocks of the rear track unit are respectively configured for abutting against a hole wall of the insertion hole of the front track unit.

In some embodiments, the protruding portion and the groove are both arc-shaped.

In some embodiments, the rotating part is a through hole defined on the protruding portion and penetrating through in the first direction;

the mating part is a crossbeam provided in the groove, and the crossbeam of the front track unit is capable of penetrating through the through hole of the rear track unit;

in a case where the track module is in the straight shape, a shortest distance between a front wall of the through hole of the rear track unit and the crossbeam of the front track unit is greater than or equal to a maximum distance between each first abutting surface of the rear track unit and a corresponding second abutting surface of the front track unit.

In some embodiments, the track module further includes a first unit and a last unit; the plurality of track units are disposed between the first unit and the last unit and include a first track unit and a last track unit; the first unit includes, on opposite ends of the first unit, a male connector and a first groove corresponding to the protruding portion of the first track unit; the last unit includes a female connector and a last protruding portion; the female connector corresponds to the male connector of another track module; the last protruding portion corresponds to the groove of the last track unit;

during assembly, the first groove of the first unit is swingably connected to the protruding portion of the first track unit; the protruding portion of the last track unit is swingably connected to the last groove of the last unit in the lateral direction; the track module is a rear track module, and the other track module is a front track module, and the male connector of the front track module is swingably connected to the female connector of the rear track module in the lateral direction.

In some embodiments, the track portion includes a support platform and a limiting wall protruding in a longitudinal direction from the support platform; the limiting wall and a side wall of the connecting portion enclose to define a driving slot; the driving slot is configured for accommodating wheels of a toy car; the driving slot extends along the front-rear direction.

The present disclosure further proposes a toy car track, including a plurality of track modules as described above, the plurality of track modules being connected end to end in sequence.

The track module of the present disclosure includes multiple track units connected sequentially. By providing the protruding portion and the groove on the connecting portion, and providing the rotating part and the mating part between the protruding portion of a rear track unit and the groove of a front track unit, a laterally swingable connection between two adjacent track units can be realized, thereby making the track module more flexible and capable of assuming different shapes.

Secondly, by providing the first abutting surfaces and the second abutting surfaces on the connecting portion, when the track module is in a straight shape, the first abutting surfaces of the rear track unit and the second abutting surfaces of the front track unit are arranged spaced apart, such that the two track units have space to swing. When the first abutting surface located on the bent side of the rear track unit abuts against the second abutting surface located on the bent side of the front track unit, it means that the two adjacent track units are bent to the limit position, thereby limiting the maximum swing amplitude of the two adjacent track units. In other words, in the present disclosure, the interval between the protruding portion of the rear track unit and the groove of the front track unit is not limited. Instead, the maximum swing amplitude of adjacent track units is limited by the first abutting surfaces and the second abutting surfaces. In this way, it is not restricted by the limitation between the rotating part and the mating part, allowing a greater swing amplitude between adjacent track units. For example, if groove walls of a snap slot are used to limit the swing amplitude of the track unit, the swing amplitude is limited by the width of the snap slot. If the width of the snap slot is small due to manufacturing precision, the swing amplitude will be small, thus failing to meet users' demand for large angles.

BRIEF DESCRIPTION OF THE DRAWINGS

In order to more clearly illustrate the technical solutions in the embodiments of the present disclosure, the drawings used in the description of the embodiments will be briefly introduced below. Obviously, the drawings in the following description are only some embodiments of the present disclosure. For those skilled in the art, other drawings may be obtained from these drawings without any creative effort.

REFERENCE NUMERALS

Figure 1:
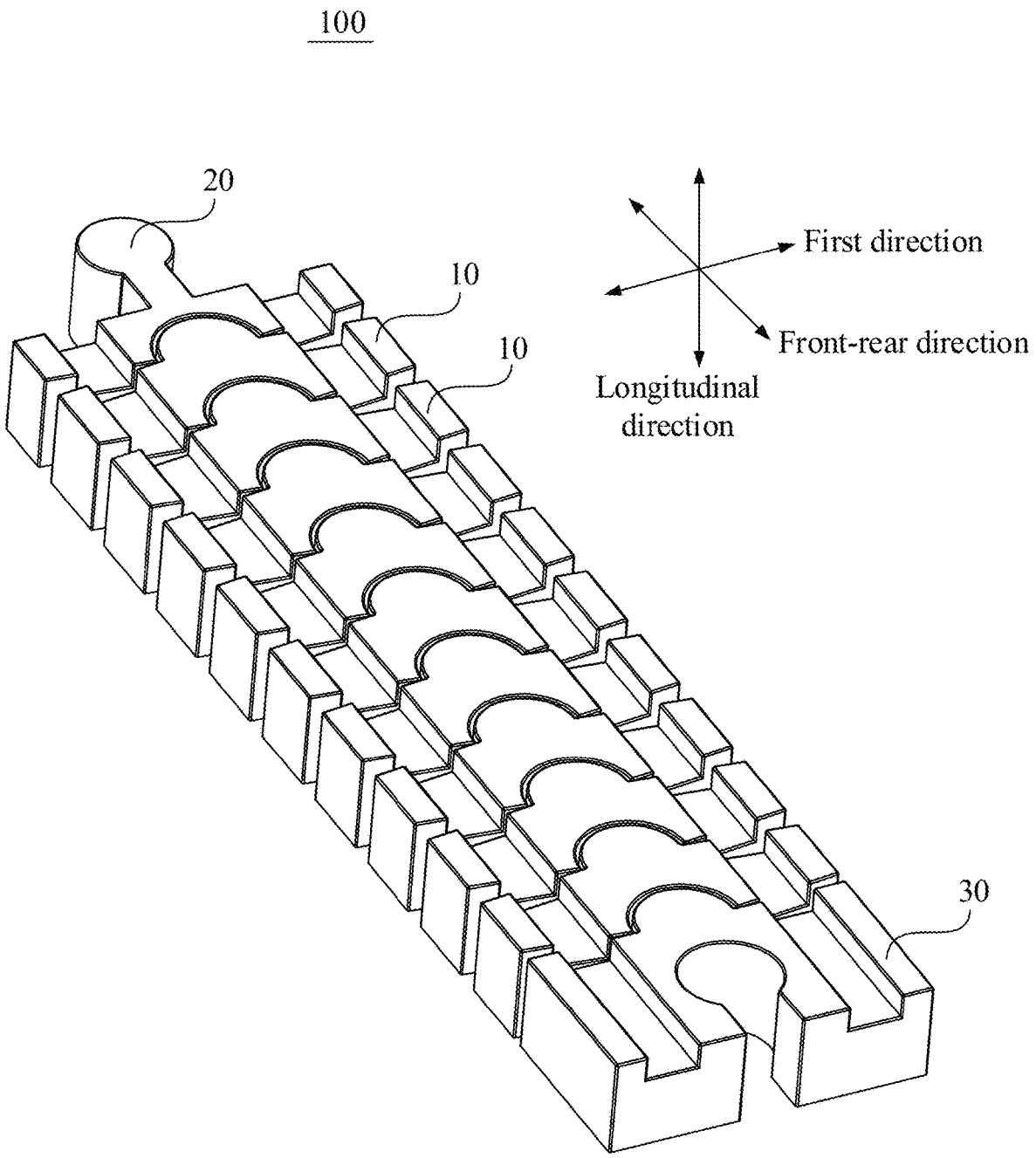
FIG. 1 shows a schematic structural diagram of a track module according to a first implementation of the present disclosure.
Figure 2:
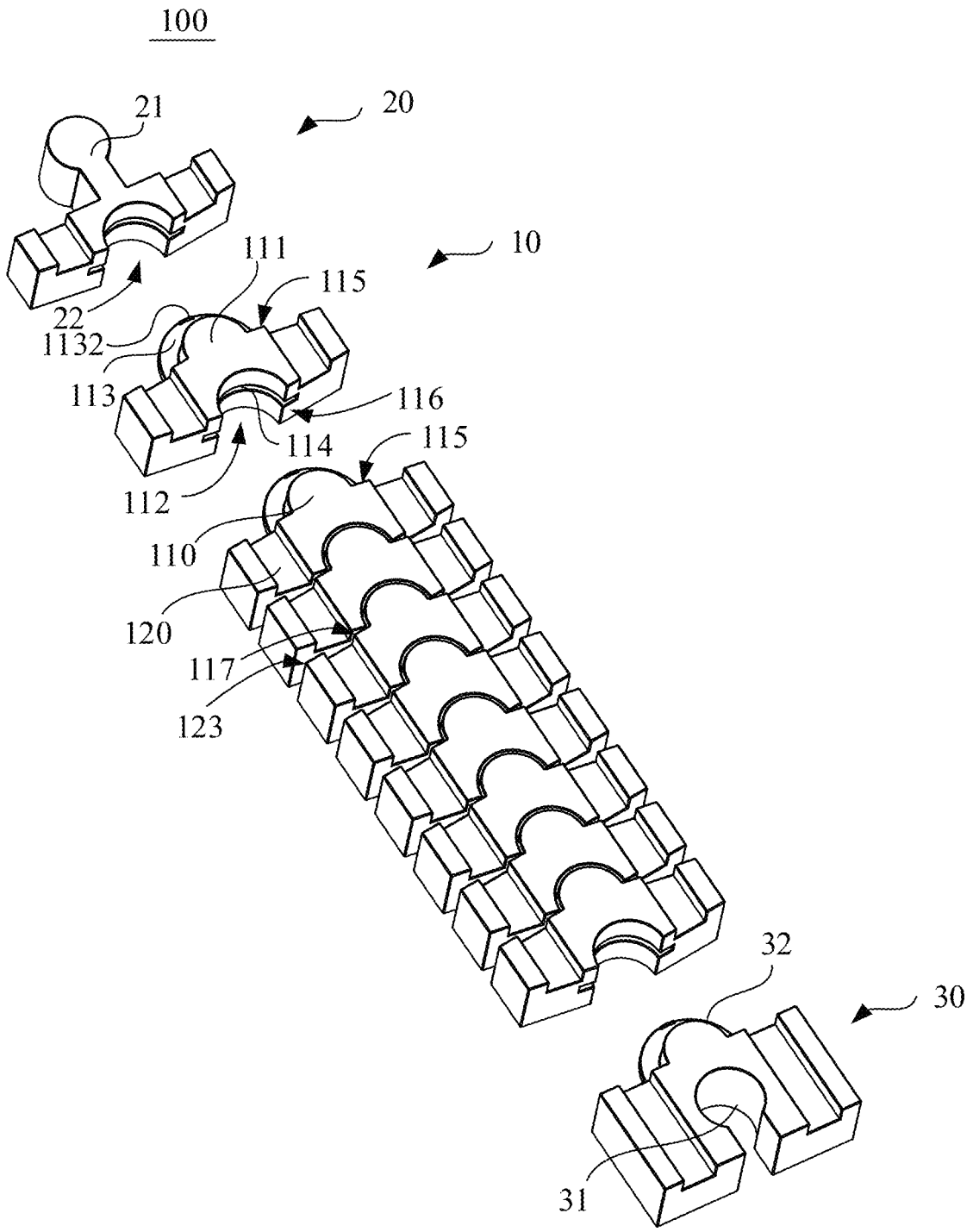
FIG. 2 is an exploded structural view of the track module according to the first implementation of the present disclosure.
Figure 3:
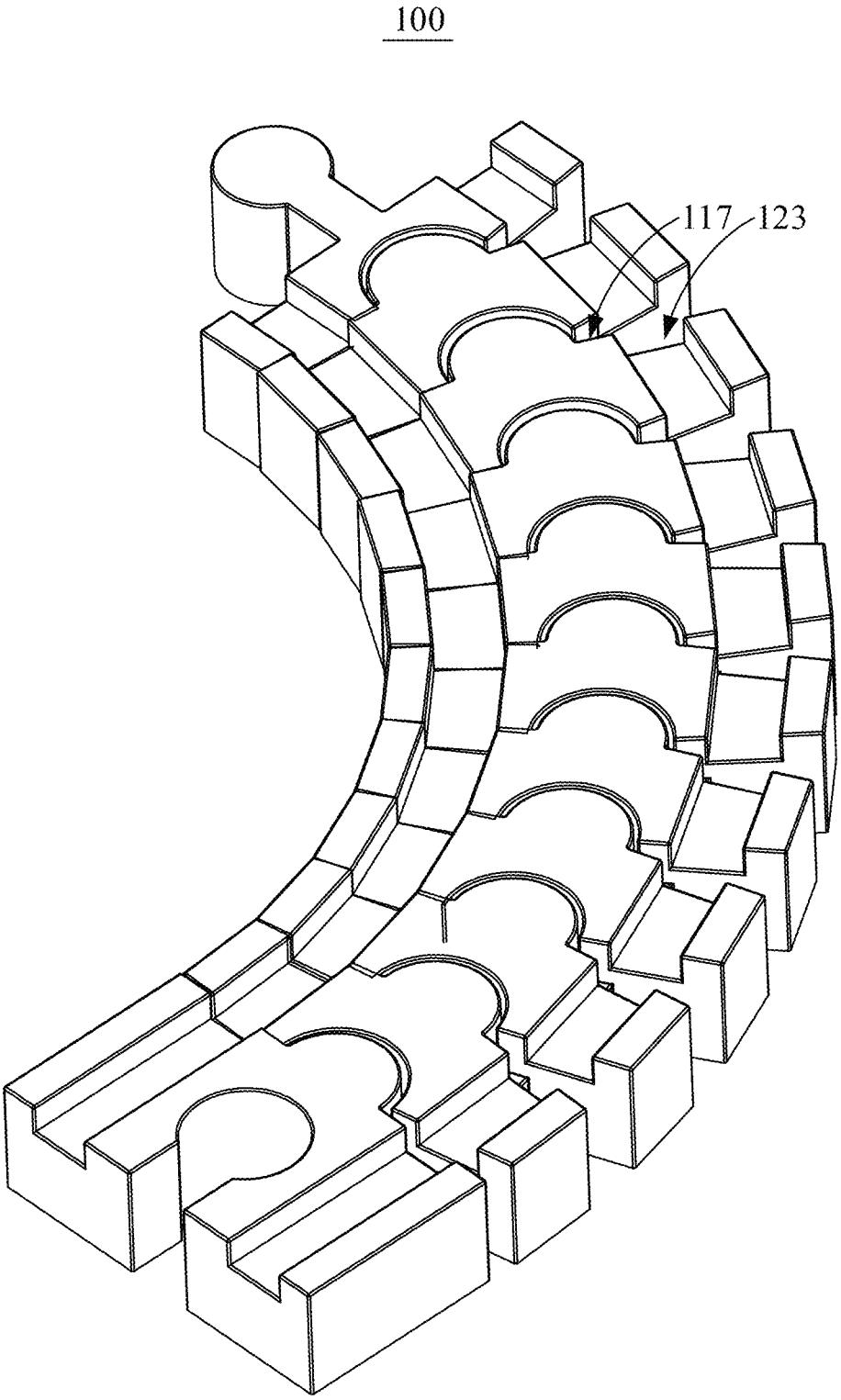
FIG. 3 is a schematic diagram of the track module in a bent state according to the first implementation of the present disclosure.
Figure 4:
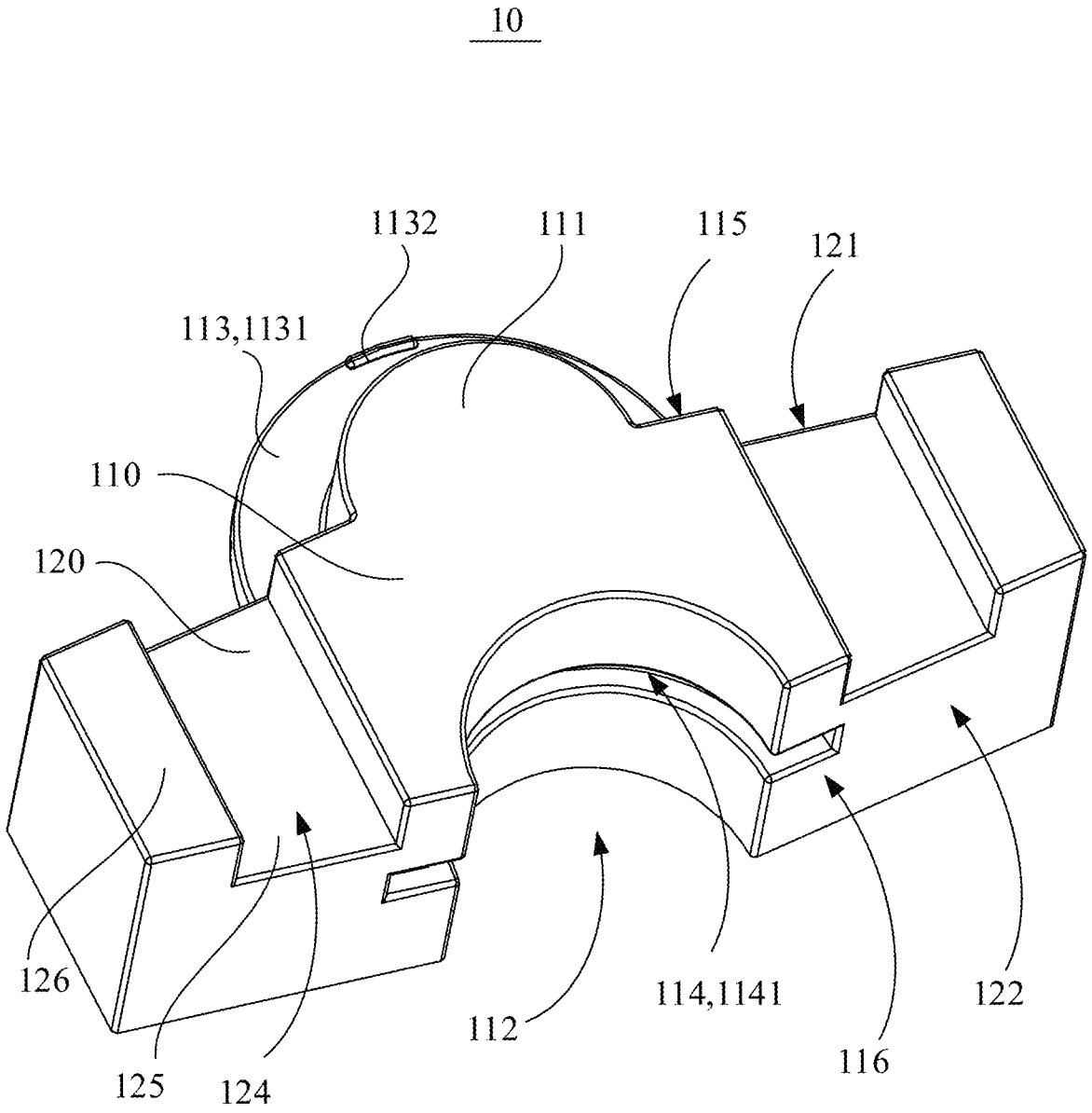
FIG. 4 is a schematic structural diagram of a track unit according to the first implementation of the present disclosure.
Figure 5:
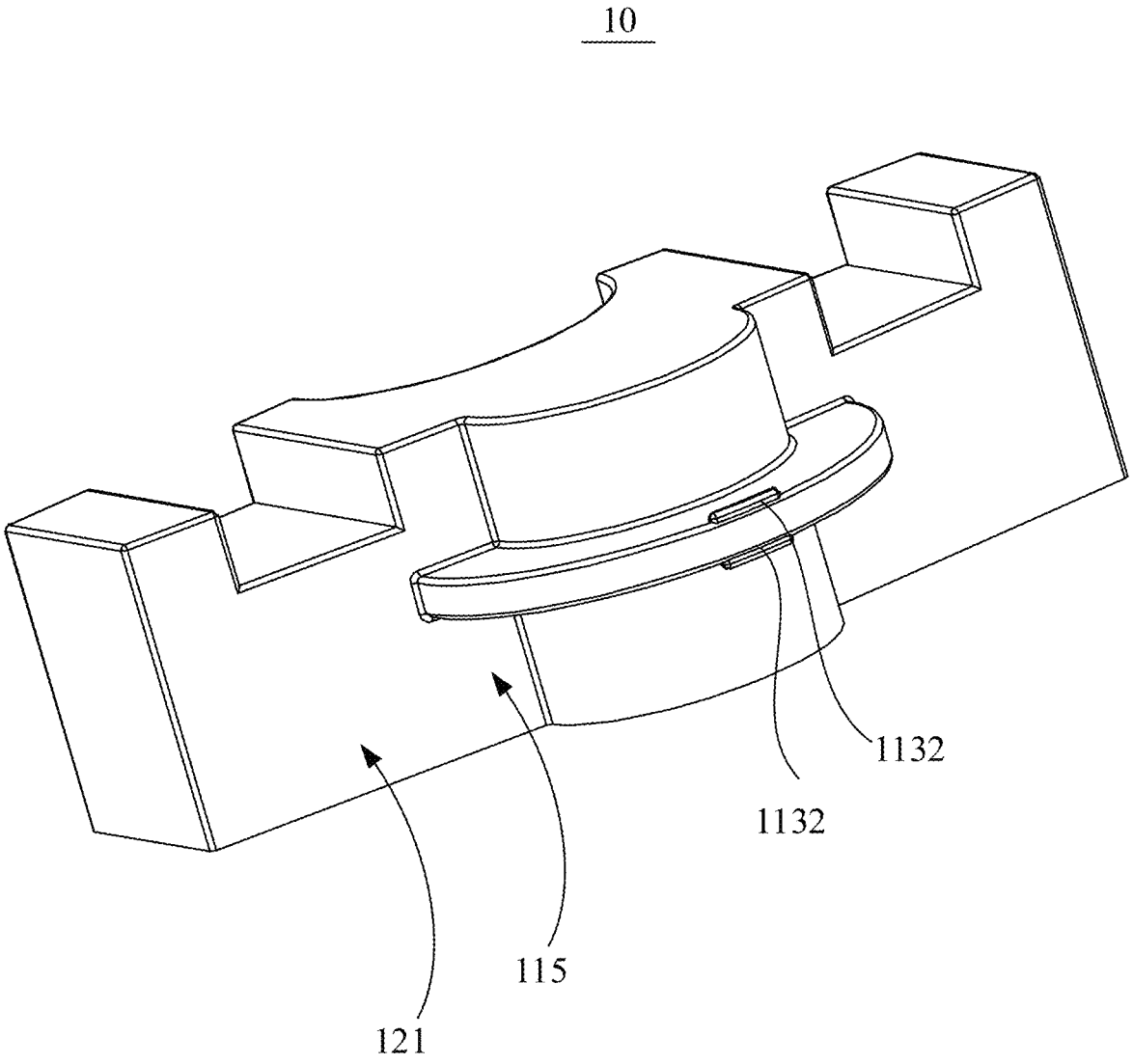
FIG. 5 is a schematic structural diagram of the track unit from another angle according to the first implementation of the present disclosure.

| No. | Name |
|---|---|
| 100 | Track module |
| 10 | Track unit |
| 110 | Connecting portion |
| 111 | Protruding portion |
| 112 | Groove |
| 113 | Rotating part |
| 1131 | Arc-shaped protrusion |
| 1132 | Engaging block |
| 1133 | Through hole |
| 114 | Mating part |
| 1141 | Insertion hole |
| 1142 | Crossbeam |
| 115 | First abutting surface |
| 116 | Second abutting surface |
| 117 | First gap |

-continued

| No. | Name |
|---|---|
| 120 | Track portion |
| 121 | First track inclined surface |
| 122 | Second track inclined surface |
| 123 | Second gap |
| 124 | Driving slot |
| 125 | Support platform |
| 126 | Limiting wall |
| 20 | First unit |
| 21 | Male connector |
| 30 | Last unit |
| 31 | Female connector |

The realization of the objective, functional features, and advantages of the present disclosure will be further described in conjunction with the embodiments and with reference to the accompanying drawings.

DETAILED DESCRIPTION

The technical solutions in the embodiments of the present disclosure will be clearly and completely described below with reference to the accompanying drawings in the embodiments of the present disclosure. Obviously, the described embodiments are only a part of the embodiments of the present disclosure, and not all of them. All other embodiments obtained by those skilled in the art based on the embodiments of the present disclosure without making creative efforts shall fall within the scope of the present disclosure. In addition, the technical solutions of the various embodiments may be combined with each other, but it must be based on the premise that those skilled in the art can realize them. When the combination of technical solutions is contradictory or cannot be realized, it shall be considered that such a combination of technical solutions does not exist and is not within the protection scope claimed by the present disclosure.

It should be noted that when directional indications (such as up, down, left, right, front, back . . . ) are involved in the embodiments of the present disclosure, these directional indications are only intended to explain the relative positional relationships, movements, etc., between components in a specific posture. When the specific posture changes, then the directional indications shall change accordingly.

Furthermore, when descriptions involving "first", "second", etc., are used in the embodiments of the present disclosure, such descriptions of "first", "second", etc., are for descriptive purposes only and cannot be understood as indicating or implying relative importance or implicitly indicating the quantity of the indicated technical features. Thus, features defined as "first" or "second" may explicitly or implicitly include at least one such feature. In addition, the meaning of "and/or" appearing throughout the text is that it includes three parallel options. Taking "A and/or B" as an example, it includes solution A, or solution B, or a solution satisfying both A and B.

The present disclosure proposes a track module 100 for a toy car track.

In the embodiments of the present disclosure, referring to FIGS. 1 to 8, the track module 100 includes multiple track units 10 connected sequentially. Each track unit 10 includes a connecting portion 110 and two track portions 120 disposed on opposite sides of the connecting portion 110 in a first direction. The connecting portion 110 is arranged with a protruding portion 111 and defines a groove 112 on opposite sides in a front-rear direction. A rotating part 113 and a mating part 114 are arranged between the protruding portion 111 of a rear track unit 10 and the groove 112 of a front track unit 10, such that two adjacent track units 10 are swingably connected in a lateral direction. The first direction and the front-rear direction cross each other on a horizontal lateral plane. The protruding portion 111 and the groove 112 are located in a middle part of the connecting portion 110. A front end of the connecting portion 110 is arranged with two first abutting surfaces 115 located on opposite sides of the protruding portion 111 in the first direction. A rear end of the connecting portion 110 is arranged with two second abutting surfaces 116 corresponding to the first abutting surface 115. When the track module 100 is in a straight shape, the first abutting surfaces 115 of a rear track unit 10 and the second abutting surfaces 116 of a front track unit 10 are arranged spaced apart. Two adjacent track units 10 can be swung laterally relative to each other to a bent state on one side. In the bent state, the first abutting surface 115 located on a bent side of the rear track unit 10 abuts against the second abutting surface 116 located on the bent side of the front track unit 10, so as to limit a swing amplitude of the two adjacent track units 10.

In the embodiments, the track module 100 refers to a basic component unit applied in a toy car track system. The track module 100 may be made of plastic. Each track module 100 is formed by connecting multiple track units 10, and can be freely spliced and combined into tracks of different shapes to meet the driving needs of toy cars. Each track module 100 may be used independently or connected with other track modules 100 to form a complete track system.

The track unit 10 is a basic component of the track module 100. Multiple track units 10 are combined through the connecting portions 110 to form one track module 100. Each track unit 10 includes a connecting portion 110 and track portions 120. The track portion 120 is a main driving path of the track unit 10 for the toy car to travel on. The connecting portion 110 is a part connecting adjacent track units 10, enabling multiple track units 10 to be combined into one track module 100.

The connecting portion 110 is a part connecting two adjacent track units 10, responsible for realizing the combination and connection of the track units 10. In the present disclosure, the connecting portion 110 is arranged with the protruding portion 111 and the groove 112 on its two sides in the front-rear direction, respectively. The configuration of the connecting portion 110 enables the track units 10 to be connected to each other through the cooperation of the protruding portion 111 and the groove 112.

The protruding portion 111 is a part protruding in the front-rear direction on the connecting portion 110, which functions to cooperate with the groove 112 of an adjacent track unit 10. The groove 112 is a recessed part on the connecting portion 110 in the front-rear direction, which is configured to accommodate the protruding portion 111 of an adjacent track unit 10. The matching design of the protruding portion 111 and the groove 112 can realize the connection and swinging function of the track units 10, giving the connection between the track units 10 a certain degree of mobility.

The rotating part 113 and the mating part 114 refer to parts between the protruding portion 111 and the groove 112, enabling the track units 10 to rotate or swing relative to each other when connected. Thus, the connection between the track units 10 is not only fixed but also has a certain degree of freedom, which can meet the needs of shapes such as curves. The rotating part 113 may adopt a spherical joint, an arc-shaped protrusion 1131, or other structures suitable for realizing swinging. The connection between the rotating part 113 and the mating part 114 may be a snap-fit connection or a lap joint, which is not limited herein.

The first abutting surface 115 is a contact surface on the connecting portion 110 located on two sides of the protruding portion 111. The second abutting surface 116 is a contact surface on the connecting portion 110 corresponding to the first abutting surface 115, located on two sides of the groove 112. When the first abutting surface 115 of the rear track unit 10 abuts against the second abutting surface 116 of the front track unit 10, it means that the two adjacent track units 10 are bent to a limit position, thereby limiting the swing amplitude of the two adjacent track units 10.

The track module 100 of the present disclosure includes multiple track units 10 connected sequentially. By providing the protruding portion 111 and the groove 112 on the connecting portion 110, and providing the rotating part 113 and the mating part 114 between the protruding portion 111 of a rear track unit 10 and the groove 112 of a front track unit 10, a laterally swingable connection between two adjacent track units 10 can be realized, thereby making the track module 100 more flexible and capable of assuming different shapes.

Secondly, by providing the first abutting surfaces 115 and the second abutting surfaces 116 on the connecting portion 110, when the track module 100 is in a straight shape, the first abutting surfaces 115 of the rear track unit 10 and the second abutting surfaces 116 of the front track unit 10 are arranged spaced apart, such that the two track units 10 have space to swing. When the first abutting surface 115 located on the bent side of the rear track unit 10 abuts against the second abutting surface 116 located on the bent side of the front track unit 10, it means that the two adjacent track units 10 are bent to the limit position, thereby limiting the maximum swing amplitude of the two adjacent track units 10. In other words, in the present disclosure, the interval between the protruding portion 111 of the rear track unit 10 and the groove 112 of the front track unit 10 is not limited. Instead, the maximum swing amplitude of adjacent track units 10 is limited by the first abutting surfaces 115 and the second abutting surfaces 116. In this way, it is not restricted by the limitation between the rotating part 113 and the mating part 114, allowing a greater swing amplitude between adjacent track units 10. For example, if groove walls of a snap slot are used to limit the swing amplitude of the track unit 10, the swing amplitude is limited by the width of the snap slot. If the width of the snap slot is small due to manufacturing precision, the swing amplitude will be small, thus failing to meet users' demand for large angles.

Further, the first abutting surface 115 and/or the second abutting surface 116 is/are an abutting inclined surface. When the track module 100 is in a straight shape, a first gap 117 exists between the first abutting surface 115 of the rear track unit 10 and the second abutting surface 116 of the front track unit 10. The abutting inclined surface is inclined from the connecting portion 110 towards a side of the track portion 120 in the first direction, deviating from the first gap 117, such that the first gap 117 gradually increases from a middle part towards an outer side in the first direction.

In some embodiments, both the first abutting surface 115 and the second abutting surface 116 are abutting inclined surfaces. In some embodiments, the first abutting surface 115 or the second abutting surface 116 is an abutting inclined surface. When the track module 100 is in a straight shape, the first gap 117 gradually increases from the middle part towards the outer side, making the connection between two adjacent track units 10 more stable and allowing a greater swing amplitude, thereby supporting more complex track shapes, such as sharp turns, curves with large curvature, etc. For example, if the first abutting surface 115 and the second abutting surface 116 are planar surfaces, planar contact would limit the range of swing angles to a smaller one. Moreover, because the contact point of planar contact is often located in an outer edge area of the two abutting surfaces, a gap may still exist between the two abutting surfaces when the two adjacent track units 10 are bent to the limit position, making the track module 100 unstable in the bent state and prone to changing the angle of the curve when the toy car travels.

In some embodiments, a front end of each track portion 120 is arranged with a first track inclined surface 121 connected to the first abutting surface 115. A rear end of each track portion 120 is arranged with a second track inclined surface 122 connected to the second abutting surface 116. The first track inclined surface 121 extends obliquely in the same direction as the first abutting surface 115. The second track inclined surface 122 extends obliquely in the same direction as the second abutting surface 116. Thus, it means that the first track inclined surface 121 and the first abutting surface 115, as well as the second track inclined surface 122 and the second abutting surface 116, each form a complete inclined surface. In this way, the structure and shape of the track unit 10 may be relatively simple, which is beneficial for improving production efficiency, and a large swing amplitude may be achieved.

Secondly, when the track module 100 is in a straight shape, a second gap 123 exists between the first track inclined surface 121 of the rear track unit 10 and the second track inclined surface 122 of the front track unit 10. The second gap 123 is communication with the first gap 117. The second gap 123 gradually increases from the connecting portion 110 towards the outer side in the first direction, allowing the contact point of the inclined surfaces to move along the inclined surfaces during the swinging process, achieving smoother swinging.

In a first implementation, referring to FIGS. 1 to 5, the rotating part 113 is an arc-shaped protrusion 1131 provided on the protruding portion 111. The arc-shaped protrusion 1131 extends from one of the first abutting surfaces 115 to the other first abutting surface 115 around a peripheral direction of the protrusion. The mating part 114 is an insertion hole defined on a bottom wall of the groove 112. The insertion hole extends from one of the second abutting surfaces 116 to the other second abutting surface 116 around the peripheral direction of the protrusion. The arc-shaped protrusion 1131 is rotatably inserted into the insertion hole, such that the first abutting surface 115 and the second abutting surface 116 located on the same side can abut against each other.

In the embodiments, the rotating part 113 is the arc-shaped protrusion 1131 provided on the protruding portion 111. The arc-shaped protrusion 1131 is arranged around the periphery of the protrusion. The mating part 114 is the insertion hole defined on the bottom wall of the groove 112. The insertion hole extends from one of the second abutting surfaces 116 to the other second abutting surface 116 around the peripheral direction of the protrusion. The arc-shaped protrusion 1131 can be inserted into the insertion hole and is rotatable around a central axis of the arc-shaped protrusion 1131. The arc-shaped protrusion 1131 and the insertion hole have a large peripheral extension range, allowing the swing angle between the track units 10 to increase significantly. When the track module 100 swings, the first abutting surface 115 and the second abutting surface 116 gradually approach and finally abut against each other during the swinging process. The limiting angle of the two adjacent track units 10 is determined by the positions of the abutting surfaces, and is no longer limited by the rotating part 113 and the mating part 114, thereby providing greater flexibility.

Secondly, in the related art, a limiting structure usually protrudes on an outer edge of the track unit 10 to limit longitudinal swinging of adjacent track units 10. In comparison, the present disclosure adopts the arrangement of the arc-shaped protrusion 1131 and the insertion hole, which may limit longitudinal swinging of adjacent track units 10, achieving the swinging function while also achieving longitudinal limiting, thereby making the structure of the track unit 10 simpler.

In addition, in the related art, the rear track unit 10 is typically installed by stacking longitudinally on the front track unit 10. This results in a greater height of the track unit 10 in the longitudinal direction, which is not conducive to the miniaturization of the track module 100. In the present disclosure, the bottom wall of the groove 112 is perpendicular to the horizontal lateral plane. That is, the rear track unit 10 can be plugged into the front track unit 10 along the front-rear direction on a horizontal plane, thereby saving longitudinal volume and making the volume of the track module 100 smaller.

Further, the arc-shaped protrusion 1131 may be arranged with an engaging block 1132.

The engaging block 1132 is detachably engaged in the insertion hole 1141, and the engaging block 1132 can slide within the insertion hole 1141 along the peripheral direction of the arc-shaped protrusion 1131.

In the embodiments, the engaging block 1132 is a block structure. The size of the insertion hole 1141 is adapted to the engaging block 1132 to allow the engaging block 1132 to be inserted, such that two adjacent track units 10 are fixedly connected, thereby improving the connection stability of the two adjacent track units 10. Meanwhile, the engaging block 1132 can slide within the insertion hole 1141 along the peripheral direction of the arc-shaped protrusion 1131, unrestricted by the hole wall of the insertion hole 1141, such that the two adjacent track units 10 limit the swing amplitude through the abutting surfaces. Secondly, the engaging block 1132 is detachably engaged in the insertion hole 1141, meaning that adjacent track units 10 can be assembled and disassembled. Users can choose the number of track units 10 as needed and freely splice them.

Further, the arc-shaped protrusion 1131 may be arranged with two engaging blocks 1132. The two engaging blocks 1132 are respectively provided on opposite sides of the arc-shaped protrusion 1131 in the longitudinal direction. The two engaging blocks 1132 are respectively configured for abutting against the hole wall of the insertion hole 1141.

In the embodiments, the two engaging blocks 1132 are respectively provided on opposite sides of the arc-shaped protrusion 1131, forming a symmetrical connection structure. This allows the connection force to be evenly distributed when the track units 10 are spliced, enhancing the stability of the connection. The contact between the two engaging blocks 1132 and the hole wall of the insertion hole 1141 provides dual support, thereby avoiding instability caused by a unilateral connection.

Further, both the protruding portion 111 and the groove 112 are arc-shaped. When the track units 10 are spliced, the design of the arc-shaped protruding portion 111 and the groove 112 allows the track unit 10 to rotate around the protruding portion 111, thereby achieving adjustability between the track units 10. The design of the arc-shaped protruding portion 111 and the groove 112 provides greater room for movement, allowing the track units 10 to rotate or swing within a larger range. This structure can support larger-angle turns or curves, providing more flexible track layouts.

Figure 6:
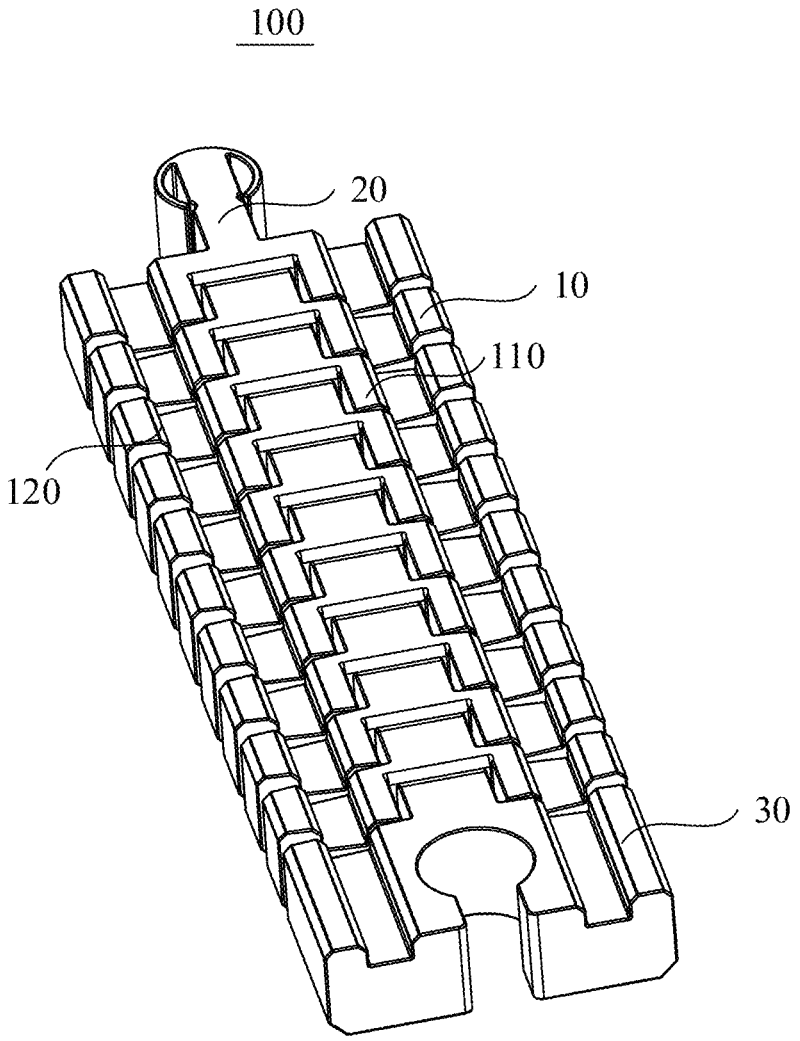
FIG. 6 is a schematic structural diagram of a track module according to a second implementation of the present disclosure.
Figure 7:
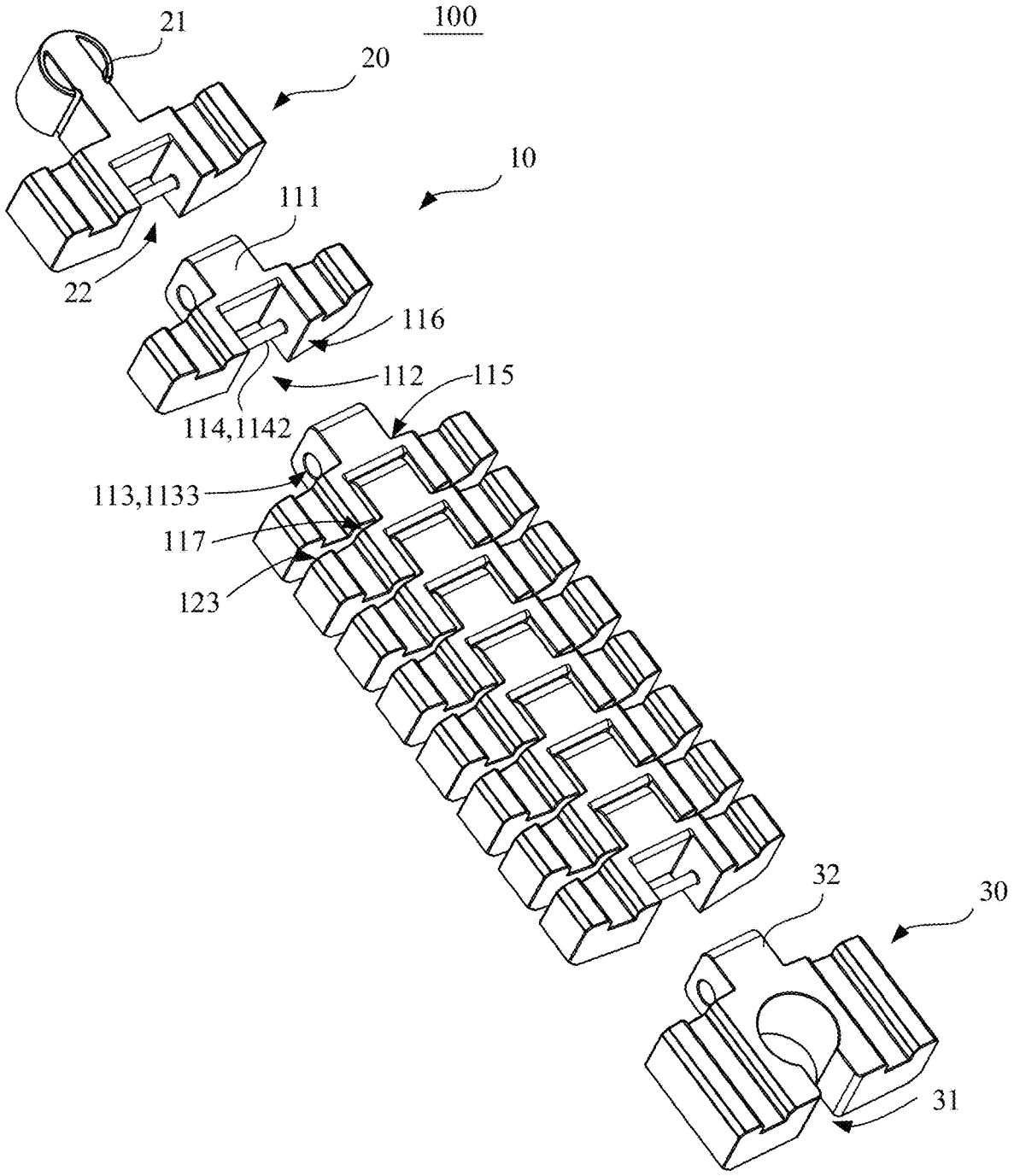
FIG. 7 is an exploded structural view of the track module according to the second implementation of the present disclosure.
Figure 8:
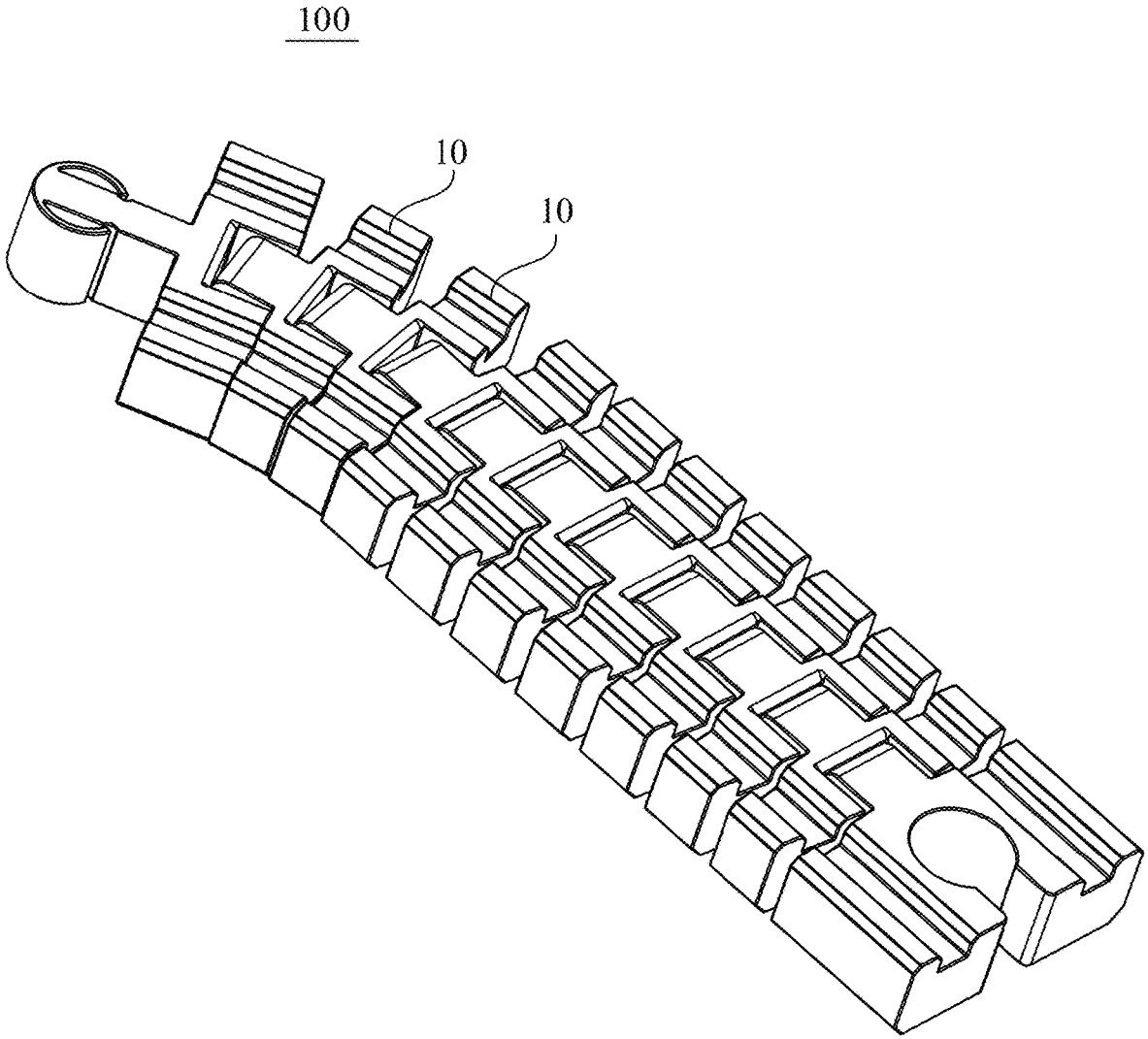
FIG. 8 is a schematic diagram of the track module in a bent state according to the second implementation of the present disclosure.

In a second implementation, referring to FIGS. 6 to 8, the rotating part 113 is a through hole 1133 defined on the protruding portion 111 and penetrating through in the first direction. The mating part 114 is a crossbeam 1142 arranged in the groove 112 and penetrating through the through hole 1133. When the track module 100 is in a straight shape, a shortest distance between the front wall of the through hole 1133 and the crossbeam 1142 is greater than or equal to a maximum distance between the first abutting surface 115 of the rear track unit 10 and the second abutting surface 116 of the front track unit 10.

The embodiments may realize the connection and rotation between track units 10 by opening the through hole 1133 in the protruding portion 111 and setting the crossbeam 1142 penetrating through the through hole 1133 in the groove 112. When the track module 100 is in a straight shape, the shortest distance between the front wall of the through hole 1133 and the crossbeam 1142 is greater than or equal to the maximum distance between the first abutting surface 115 and the second abutting surface 116. This means that when the track units 10 are connected, the rotating part 113 (i.e., the through hole 1133) and the mating part 114 (i.e., the crossbeam 1142) do not directly limit the swing angle. Instead, the maximum swing range of the track unit 10 is controlled by the first abutting surface 115 and the second abutting surface 116, making the swing angle more flexible and adjustable.

In some embodiments, the track module 100 further includes a first unit 20 and a last unit 30. The first unit 20 includes, at its opposite ends, a male connector 21 and a groove 22 corresponding to the protruding portion 111 of a first track unit 10. The last unit 30 includes a female connector 31 and a protruding portion 32. The female connector 31 corresponds to the male connector 21. The protruding portion 32 corresponds to the groove 112 of a last track unit 10. The groove 22 may have a same structure as the groove 112 of each track unit 10, and the protruding portion 32 may have a same structure as the protruding portion 111 of each track unit 10.

During assembly, the groove 22 of the first unit 20 is swingably connected to the protruding portion 111 of the first track unit 10. The groove 112 of the last track unit 10 is swingably connected to the protruding portion 32 of the last unit 30. The male connector 21 of a front track module 100 can be swingably connected to the female connector 31 of a rear track module 100.

In the embodiments, the track module 100 further includes the first unit 20 and the last unit 30. Adjacent track modules 100 are connected through the first unit 20 and the last unit 30. In one track module 100, multiple track units 10 are connected between the first unit 20 and the last unit 30.

In some embodiments, the track portion 120 includes a support platform 125 and a limiting wall 126 protruding longitudinally from the support platform 125. The limiting wall 126 and a side wall of the connecting portion 110 enclose to define a driving slot 124. The driving slot 124 is configured for accommodating wheels of a toy car. The driving slot 124 extends along the front-rear direction.

In the embodiments, the track portion 120 includes the support platform 125 and the limiting wall 126. The limiting wall 126 and the side wall of the connecting portion 110 enclose to define the driving slot 124. The driving slot 124 is configured for accommodating the wheels, providing more precise guiding function. The wheels are guided within the slot, allowing the toy car to travel more stably and less likely to deviate from the track. In addition, the driving slot 124 is defined by enclosing the side wall of the connecting portion 110 and the limiting wall 126. In this way, while the dimension in the first direction is fixed, a larger size can be reserved for the driving slot 124 as much as possible to accommodate wheels of different widths of toy cars. Meanwhile, this allows the areas of the first abutting surface 115 and the second abutting surface 116 to be smaller, making it less prone to having a gap between the two abutting surfaces due to machining precision. Consequently, the fit between the first abutting surface 115 of one track unit 10 and the second abutting surface 116 of an adjacent track unit 10 is tighter.

The present disclosure further proposes a toy car track. The toy car track includes multiple track modules 100. For the specific structure of the track module 100, reference may be made to the above embodiments. Since this toy car track adopts all the technical solutions of all the above embodiments, it at least has all the beneficial effects brought by the technical solutions of the above embodiments, which are not repeated here one by one. Among them, the multiple track modules 100 are connected end to end in sequence.

Finally, it should be noted that the above embodiments are only intended to illustrate the technical solutions of the present disclosure, and are not intended to limit them. Although the present disclosure has been described in detail with reference to the foregoing embodiments, those skilled in the art should understand that they can still modify the technical solutions described in the foregoing embodiments, or equivalently replace some of the technical features; and these modifications or replacements do not make the essence of the corresponding technical solutions deviate from the spirit and scope of the technical solutions of the various embodiments of the present disclosure.

What is claimed is:

1. A track module, comprising a plurality of track units connected sequentially; wherein each track unit comprises a connecting portion and two track portions disposed on opposite sides of the connecting portion in a first direction;

wherein the connecting portion is arranged with a protruding portion and defines a groove, and the protruding portion and the groove are disposed on opposite sides in a front-rear direction;

for each adjacent two track units among the plurality of track units, the adjacent two track units are a front track unit and a rear track unit in the front-rear direction; a rotating part and a mating part are arranged between the protruding portion of the rear track unit and the groove of the front track unit, enabling the adjacent two track units to be swingably connected in a lateral direction; the first direction and the front-rear direction intersect each other on a horizontal lateral plane;

the protruding portion and the groove are disposed in a middle part of the connecting portion; a front end of the connecting portion is arranged with two first abutting surfaces located on opposite sides of the protruding portion in the first direction; a rear end of the connecting portion is arranged with two second abutting surfaces corresponding to the first abutting surfaces;

in a case where the track module is in a straight shape, the two first abutting surfaces of the rear track unit and the two second abutting surfaces of the front track unit are arranged spaced apart; the adjacent two track units are capable of being swung laterally relative to each other to a bent state on one side; in the bent state, one of the two first abutting surfaces located on a bent side of the rear track unit abuts against the one of the two second abutting surfaces located on the bent side of the front track unit, for limiting a swing amplitude of the adjacent two track units;

wherein the rotating part is a through hole defined on the protruding portion and penetrating through in the first direction;

the mating part is a crossbeam provided in the groove, and the crossbeam of the front track unit is capable of penetrating through the through hole of the rear track unit;

in a case where the track module is in the straight shape, a shortest distance between a front wall of the through hole of the rear track unit and the crossbeam of the front track unit is greater than or equal to a maximum distance between each first abutting surface of the rear track unit and a corresponding second abutting surface of the front track unit.

2. The track module according to claim 1, wherein at least one of each first abutting surface and each second abutting surface is an abutting inclined surface;

in a case where the track module is in the straight shape, a first gap exists between each first abutting surface of the rear track unit and a corresponding second abutting surface of the front track unit; the abutting inclined surface is inclined from the connecting portion towards a side of the track portion in the first direction, deviating from the first gap, causing the first gap to gradually increase from the middle part towards an outer side in the first direction.

3. The track module according to claim 2, wherein a front end of each track portion is arranged with a first track inclined surface connected to a corresponding first abutting surface; a rear end of each track portion is arranged with a second track inclined surface connected to a corresponding second abutting surface;

the first track inclined surface extends obliquely in a same direction as the first abutting surface; the second track inclined surface extends obliquely in a same direction as the second abutting surface.

4. The track module according to claim 1, wherein the rotating part is an arc-shaped protrusion arranged on the protruding portion; the arc-shaped protrusion extends from one of the two first abutting surfaces to the other of the two first abutting surfaces around a peripheral direction of the arc-shaped protrusion;

the mating part is an insertion hole defined on a bottom wall of the groove; the insertion hole extends from one of the two second abutting surfaces to the other of the two second abutting surfaces around the peripheral direction of the arc-shaped protrusion;

the arc-shaped protrusion of the rear track unit is capable of being rotatably inserted into the insertion hole of the front track unit, enabling each first abutting surface and a corresponding second abutting surface located on a same side to abut against each other.

5. The track module according to claim 4, wherein the arc-shaped protrusion is arranged with at least one engaging block; the at least one engaging block of the rear track unit is capable of being detachably engaged in the insertion hole of the front track unit, and the at least one engaging block of the rear track unit is slidable within the insertion hole of the front track unit along the peripheral direction of the arc-shaped protrusion of the rear track unit.

6. The track module according to claim 5, wherein the at least one engaging block is two engaging blocks; the two engaging blocks are respectively disposed on opposite sides of the arc-shaped protrusion in a longitudinal direction; the two engaging blocks of the rear track unit are respectively configured for abutting against a hole wall of the insertion hole of the front track unit.

7. The track module according to claim 4, wherein the protruding portion and the groove are both arc-shaped.

8. The track module according to claim 1, wherein the track module further comprises a first unit and a last unit; the plurality of track units are disposed between the first unit and the last unit and comprise a first track unit and a last track unit; the first unit comprises, on opposite ends of the first unit, a male connector and a first groove corresponding to the protruding portion of the first track unit; the last unit comprises a female connector and a last protruding portion; the female connector corresponds to the male connector of another track module; the last protruding portion corresponds to the groove of the last track unit;

during assembly, the first groove of the first unit is swingably connected to the protruding portion of the first track unit; the protruding portion of the last track unit is swingably connected to the last groove of the last unit in the lateral direction; the track module is a rear track module, and the other track module is a front track module, and the male connector of the front track module is swingably connected to the female connector of the rear track module in the lateral direction.

9. The track module according to claim 1, wherein the track portion comprises a support platform and a limiting wall protruding in a longitudinal direction from the support platform; the limiting wall and a side wall of the connecting portion enclose to define a driving slot; the driving slot is configured for accommodating wheels of a toy car; the driving slot extends along the front-rear direction.

10. A toy car track, comprising a plurality of track modules; wherein the plurality of track modules are connected end to end in sequence;

wherein each track module comprises a plurality of track units connected sequentially; wherein each track unit comprises a connecting portion and two track portions disposed on opposite sides of the connecting portion in a first direction;

wherein the connecting portion is arranged with a protruding portion and defines a groove, and the protruding portion and the groove are disposed on opposite sides in a front-rear direction;

for each adjacent two track units among the plurality of track units, the adjacent two track units are a front track unit and a rear track unit in the front-rear direction; a rotating part and a mating part are arranged between the protruding portion of the rear track unit and the groove of the front track unit, enabling the adjacent two track units to be swingably connected in a lateral direction; the first direction and the front-rear direction intersect each other on a horizontal lateral plane;

the protruding portion and the groove are disposed in a middle part of the connecting portion; a front end of the connecting portion is arranged with two first abutting surfaces located on opposite sides of the protruding portion in the first direction; a rear end of the connecting portion is arranged with two second abutting surfaces corresponding to the first abutting surfaces;

in a case where the track module is in a straight shape, the two first abutting surfaces of the rear track unit and the two second abutting surfaces of the front track unit are arranged spaced apart; the adjacent two track units are capable of being swung laterally relative to each other to a bent state on one side; in the bent state, one of the two first abutting surfaces located on a bent side of the rear track unit abuts against the one of the two second abutting surfaces located on the bent side of the front track unit, for limiting a swing amplitude of the adjacent two track units;

wherein the rotating part is a through hole defined on the protruding portion and penetrating through in the first direction;

the mating part is a crossbeam provided in the groove, and the crossbeam of the front track unit is capable of penetrating through the through hole of the rear track unit;

in a case where the track module is in the straight shape, a shortest distance between a front wall of the through hole of the rear track unit and the crossbeam of the front track unit is greater than or equal to a maximum distance between each first abutting surface of the rear track unit and a corresponding second abutting surface of the front track unit.

11. The toy car track according to claim 10, wherein at least one of each first abutting surface and each second abutting surface is an abutting inclined surface;

in a case where the track module is in the straight shape, a first gap exists between each first abutting surface of the rear track unit and a corresponding second abutting surface of the front track unit; the abutting inclined surface is inclined from the connecting portion towards a side of the track portion in the first direction, deviating from the first gap, causing the first gap to gradually increase from the middle part towards an outer side in the first direction.

12. The toy car track according to claim 11, wherein a front end of each track portion is arranged with a first track inclined surface connected to a corresponding first abutting surface; a rear end of each track portion is arranged with a second track inclined surface connected to a corresponding second abutting surface;

the first track inclined surface extends obliquely in a same direction as the first abutting surface; the second track inclined surface extends obliquely in a same direction as the second abutting surface.

13. The toy car track according to claim 10, wherein the rotating part is an arc-shaped protrusion arranged on the protruding portion; the arc-shaped protrusion extends from one of the two first abutting surfaces to the other of the two first abutting surfaces around a peripheral direction of the arc-shaped protrusion;

the mating part is an insertion hole defined on a bottom wall of the groove; the insertion hole extends from one of the two second abutting surfaces to the other of the two second abutting surfaces around the peripheral direction of the arc-shaped protrusion;

the arc-shaped protrusion of the rear track unit is capable of being rotatably inserted into the insertion hole of the front track unit, enabling each first abutting surface and a corresponding second abutting surface located on a same side to abut against each other.

14. The toy car track according to claim 13, wherein the arc-shaped protrusion is arranged with at least one engaging block; the at least one engaging block of the rear track unit is capable of being detachably engaged in the insertion hole of the front track unit, and the at least one engaging block of the rear track unit is slidable within the insertion hole of the front track unit along the peripheral direction of the arc-shaped protrusion of the rear track unit.

15. The toy car track according to claim 14, wherein the at least one engaging block is two engaging blocks; the two engaging blocks are respectively disposed on opposite sides of the arc-shaped protrusion in a longitudinal direction; the two engaging blocks of the rear track unit are respectively configured for abutting against a hole wall of the insertion hole of the front track unit.

16. The toy car track according to claim 13, wherein the protruding portion and the groove are both arc-shaped.

17. The toy car track according to claim 10, wherein the track module further comprises a first unit and a last unit; the plurality of track units are disposed between the first unit and the last unit and comprise a first track unit and a last track unit; the first unit comprises, on opposite ends of the first unit, a male connector and a first groove corresponding to the protruding portion of the first track unit; the last unit comprises a female connector and a last protruding portion; the female connector corresponds to the male connector of another track module; the last protruding portion corresponds to the groove of the last track unit;

during assembly, the first groove of the first unit is swingably connected to the protruding portion of the first track unit; the protruding portion of the last track unit is swingably connected to the last groove of the last unit in the lateral direction; the track module is a rear track module, and the other track module is a front track module, and the male connector of the front track module is swingably connected to the female connector of the rear track module in the lateral direction.

18. The toy car track according to claim 10, wherein the track portion comprises a support platform and a limiting wall protruding in a longitudinal direction from the support platform; the limiting wall and a side wall of the connecting portion enclose to define a driving slot; the driving slot is configured for accommodating wheels of a toy car; the driving slot extends along the front-rear direction.

19. A track module, comprising a plurality of track units connected sequentially; wherein each track unit comprises a connecting portion and two track portions disposed on opposite sides of the connecting portion in a first direction;

wherein the connecting portion is arranged with a protruding portion and defines a groove, and the protruding portion and the groove are disposed on opposite sides in a front-rear direction;

for each adjacent two track units among the plurality of track units, the adjacent two track units are a front track unit and a rear track unit in the front-rear direction; a rotating part and a mating part are arranged between the protruding portion of the rear track unit and the groove of the front track unit, enabling the adjacent two track units to be swingably connected in a lateral direction; the first direction and the front-rear direction intersect each other on a horizontal lateral plane;

the protruding portion and the groove are disposed in a middle part of the connecting portion; a front end of the connecting portion is arranged with two first abutting surfaces located on opposite sides of the protruding portion in the first direction; a rear end of the connecting portion is arranged with two second abutting surfaces corresponding to the first abutting surfaces;

in a case where the track module is in a straight shape, the two first abutting surfaces of the rear track unit and the two second abutting surfaces of the front track unit are arranged spaced apart; the adjacent two track units are capable of being swung laterally relative to each other to a bent state on one side; in the bent state, one of the two first abutting surfaces located on a bent side of the rear track unit abuts against the one of the two second abutting surfaces located on the bent side of the front track unit, for limiting a swing amplitude of the adjacent two track units;

wherein the rotating part is an arc-shaped protrusion arranged on the protruding portion; the arc-shaped protrusion extends from one of the two first abutting surfaces to the other of the two first abutting surfaces around a peripheral direction of the arc-shaped protrusion;

the mating part is an insertion hole defined on a bottom wall of the groove; the insertion hole extends from one of the two second abutting surfaces to the other of the two second abutting surfaces around the peripheral direction of the arc-shaped protrusion;

the arc-shaped protrusion of the rear track unit is capable of being rotatably inserted into the insertion hole of the front track unit, enabling each first abutting surface and a corresponding second abutting surface located on a same side to abut against each other;

wherein the arc-shaped protrusion is arranged with at least one engaging block; the at least one engaging block of the rear track unit is capable of being detachably engaged in the insertion hole of the front track unit, and the at least one engaging block of the rear track unit is slidable within the insertion hole of the front track unit along the peripheral direction of the arc-shaped protrusion of the rear track unit.

* * * * *